United States Patent [19]

Schmidt-Kufeke et al.

[11] Patent Number: 4,640,803

[45] Date of Patent: Feb. 3, 1987

[54] TUBULAR VENTILATOR

[76] Inventors: Klaus-Peter Schmidt-Kufeke, Bernhardstr., 7500 Karlsruhe 1; Gerhard Feld, Am Erl-Anger 3, 8501 Eckenthal, both of Fed. Rep. of Germany

[21] Appl. No.: 766,816

[22] Filed: Aug. 16, 1985

[51] Int. Cl.[4] ..... B01F 3/04

[52] U.S. Cl. ..... 261/64.3; 261/122

[58] Field of Search ..... 261/64 B, 122

[56] References Cited

U.S. PATENT DOCUMENTS

| | | | |
|---|---|---|---|
| 2,686,139 | 8/1954 | Lamb et al. | 261/124 |
| 3,911,068 | 10/1975 | Hamilton | 261/122 |
| 4,060,486 | 11/1977 | Schreiber | 261/122 |
| 4,165,286 | 8/1979 | Schreiber et al. | 261/122 |
| 4,489,016 | 12/1984 | Kriebel | 261/122 |
| 4,557,879 | 12/1985 | Weber | 261/122 |

FOREIGN PATENT DOCUMENTS

| | | | |
|---|---|---|---|
| 529020 | 10/1930 | Fed. Rep. of Germany | 261/122 |
| 554877 | 3/1923 | France | 261/122 |
| 1044737 | 6/1953 | France | 261/122 |

*Primary Examiner*—Tim Miles

[57] ABSTRACT

A tubular ventilator has a rigid supporting tube provided with radial bores over which a foil-like hose with superfine pores is drawn, the tube is covered at its ends by covers having center bores for connecting two gas lines, the interior of the tube is subdivided into two halves each provided with a pressure-tightly displaceable plunger.

14 Claims, 8 Drawing Figures

| State / Process | Inlet Valve 28 | Outlet Valve 29 |
|---|---|---|
| Rising | OPEN | CLOSED |
| Lowering | CLOSED | OPEN |
| Floating | CLOSED | CLOSED |

TUBULAR VENTILATOR

The invention starts out from a tubular ventilator for introducing gases into liquids, of the type as set forth in the preamble of claim 1.

Ventilators of the aforementioned type are known. One embodiment which is being manufactured by the firm of Schumacher'sche Fabrik GmbH and Co. KG, Bietigheim/Germany, employs porous ceramic tube-type ventilators, several of which are assembled to form ventilating grids. They are intended for use with settling tanks or the like. Via gravity lines the ventilating grids are slewably mounted to the side of the settling tank or reservoir. For the purpose of being cleaned, the ventilating grids which, in the operating condition, are lowered into the tank or reservoir, can be swivelled up and raised over the side of the tank with the aid of a special lifting apparatus. This type of ventilating system, however, is only suitable for the intended type of operation referred to hereinbefore.

There are quite a number of cases, however, in which the introduction of gases, preferably of air or oxygen, into liquids or fluids is desirable, but which do not permit of a fixed mounting of a ventilating facility.

In cases like these it is common practice to lay tubes provided with relatively large holes firmly on the bottom or floor of the waters, or to anchor them floatingly at the bottom or on the floor of the waters. However, there are further cases of practical application requiring the introduction of gases into liquids or fluids, in which the permanent installation of a ventilating system is only possible under very difficult conditions and is therefore either too expensive or impossible, such as in deep waters, sea gulfs, or on the high seas. Moreover, a fixed installation has the disadvantage that the maintenance and the cleaning would be rendered very difficult.

It is the object of the invention to provide a tubular ventilator of finite length which can be freely installed and which, by having a superfine porous surface, safeguards an optimum introduction of gas into a liquid.

This object is achieved by the features set forth in the characterizing part of claim 1. Advantageous further embodiments of the subject matter of the invention are set forth in the subclaims.

The advantages achievable by the invention reside above all in that the supporting tube may be stable and, consequently, relatively heavy, and is provided with largely dimensioned radial bores, in that the foil-like hose which surrounds the tube, may be relatively thin, thus providing for the possibility of a superfine perforation, that in the event of a damaging and/or clogging of the pores, only the porous hose needs to be replaced at low cost, and in that, in further embodying the invention, the flooding of the supporting tube effects a lowering onto the bottom of the water, and in that by a gas pressure capable of being controlled from the outside, the volume of the flooding chambers becomes in such a way adjustable that the tubular ventilator will assume a defined depth-of-water position, and can be caused to either maintain this position or to swim up. Moreover, it is possible to restrict the ventilation or aeration to certain depth-of-water ranges.

In the following the invention will now be explained in greater detail with reference to several examples of embodiments shown in FIGS. 1 to 8 of the accompanying drawings, in which:

FIG. 1 in a not-to-scale representation, shows a first type of embodiment of a tubular ventilator according to the invention, in a sectional view.

Figure 5:
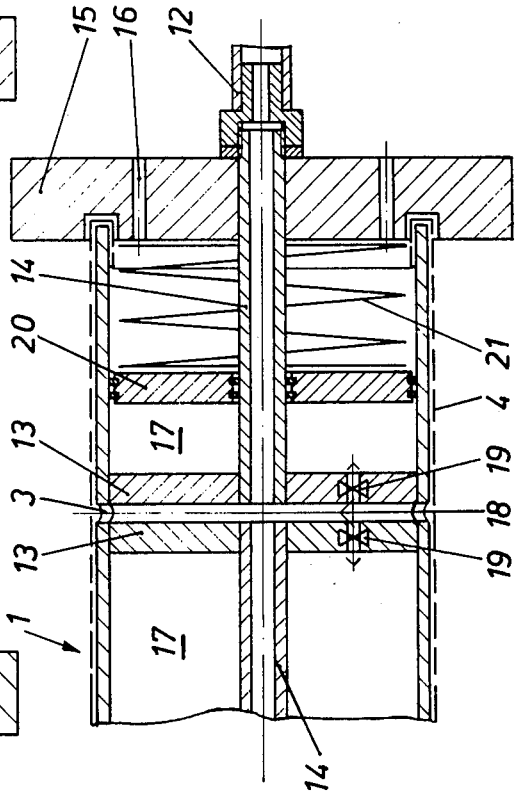

FIG. 5 in a not-to-scale representation, shows a third type of embodiment of a tubular ventilator according to the invention in both a partial and sectional representation.

Figures 6, 7:
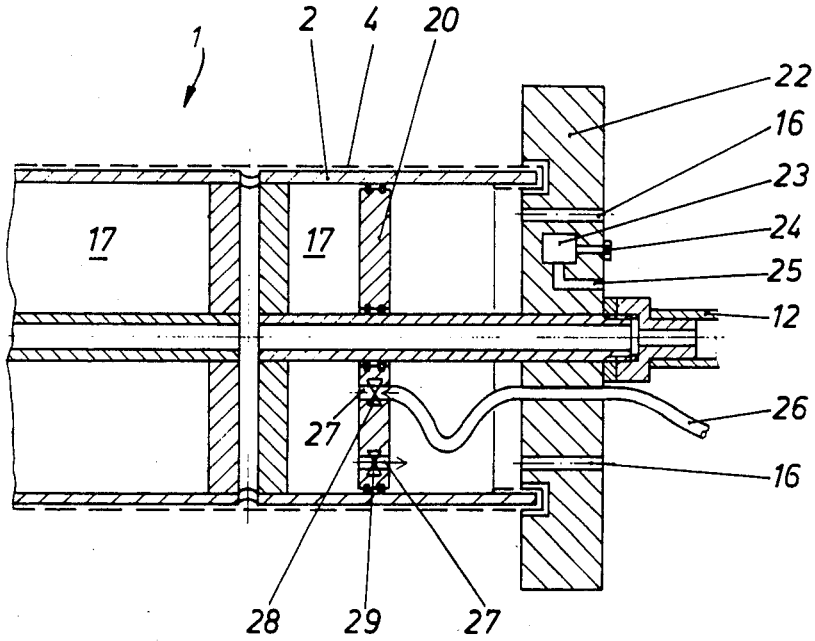

FIG. 6 in a schematic representation, shows a fourth type of embodiment of a tubular ventilator according to the invention, in both a partial and sectional view.

FIG. 7 shows a logic diagram referring to the depth adjustment of the tubular ventilator as shown in FIG. 6.

Figure 8:
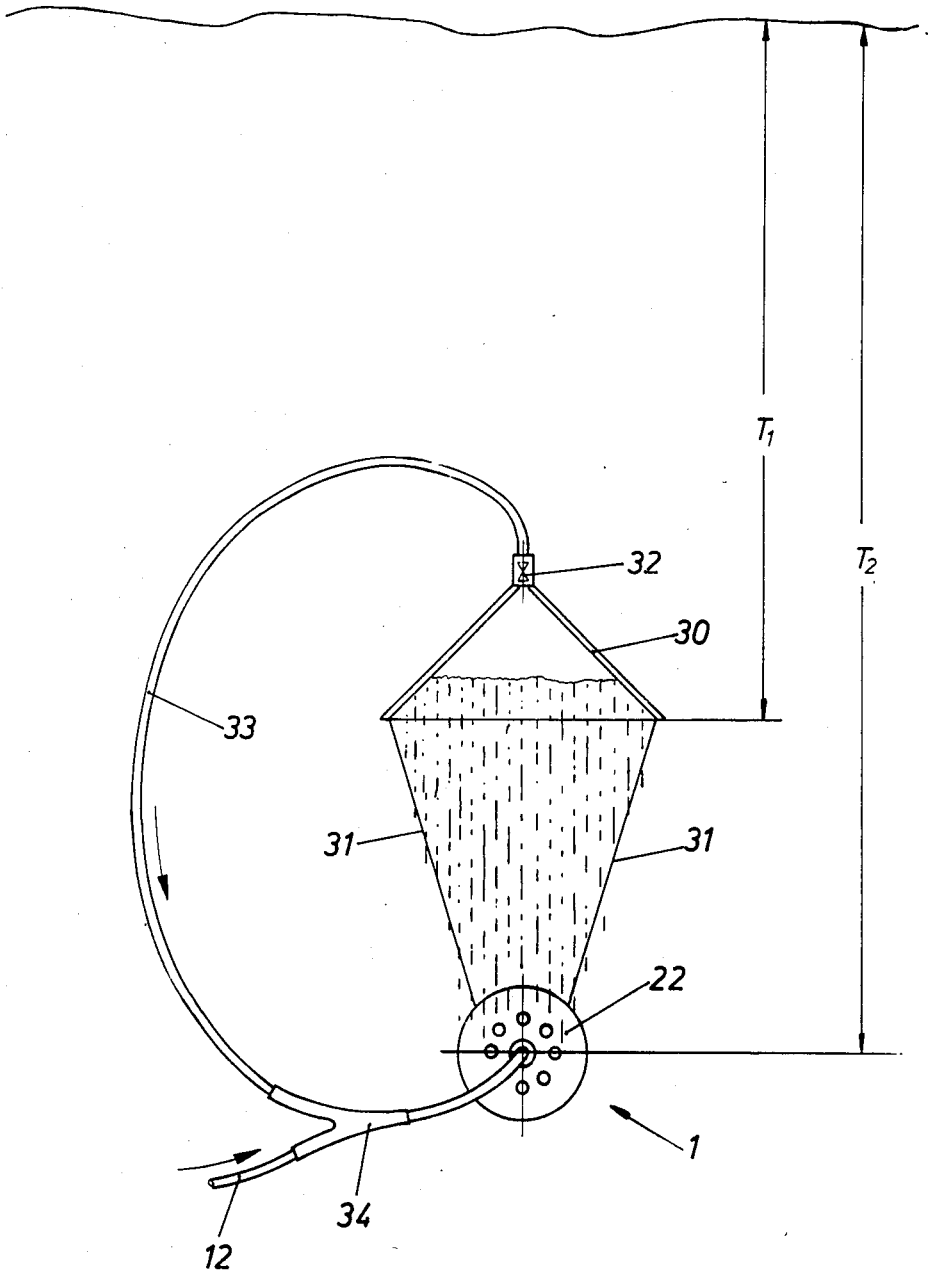

FIG. 8 shows a tubular ventilator according to the invention comprising a deep-water aeration facility, in a schematical representation.

Figure 2:
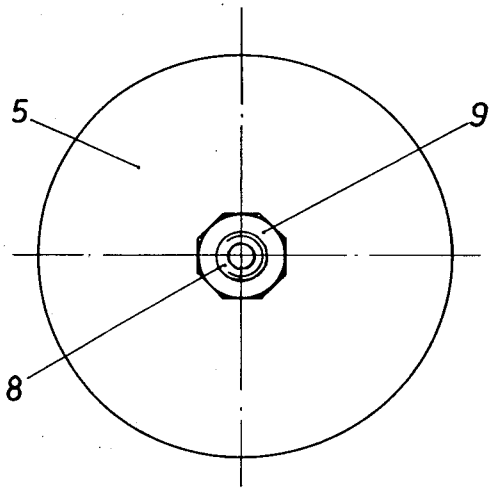
FIG. 2 shows the ventilator of FIG. 1 in a front view.
Figure 1:
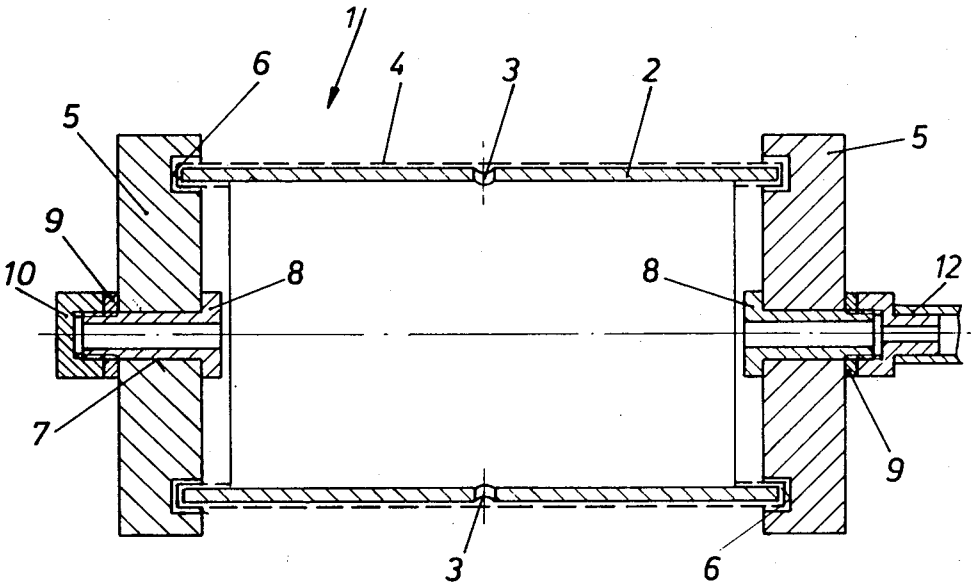

FIGS. 1 and 2, in a not-to-scale and simplified, sectional representation, show a first type of embodiment of a tubular ventilator (aka aerator) 1. It chiefly consists of a rigid supporting tube 2 of finite length over which there is drawn a foil-like hose 4 provided with superfine pores. At the ends of the tube, the hose 4 is turned up inwardly. At both ends sealing covers 5 serve to close the thus prepared supporting tube 2 which engages into annular grooves 6 provided for in the covers 5, which contain not shown gasket or sealing rings for pressure-tightly closing (sealing) both the supporting tube 2 and the hose 4 as slipped thereover. In its center, for example, the supporting tube 2 is provided all around with radial bores 3. The material of the hose 4 can be provided with superfine pores produced e.g. by employing the process disclosed in the U.S. patent application Ser. No. 608,023, filed May 3, 1984. Each of the covers 5 has a center bore 7 in which a flanged bush 8 with an external thread is disposed in a pressure-tight manner and retained by means of a nut 9. The projecting part of the threaded bushes 8 serve the connection of a pressure line 12 and, in the case of an end-sided ventilator 1, to receive an end cap 10.

When a pressurized gas is supplied to the ventilator 1 of the type as described hereinbefore, through the pressure 12, then this gas escapes through the radial bores 3 provided for in the supporting tube 2 and, owing to the pressure, becomes distributed along the entire circumference below the hose 4. At a sufficient pressure the gas escapes in the finest distribution through the pores. Due to its large hollow space, such a ventilator 1 is capable of floating. For this reason it is necessary for the floatable ventilator to be anchored either at the bottom of the vessel containing the liquid or fluid to be ventilated or aerated, or on the floor of the waters.

Figure 4:
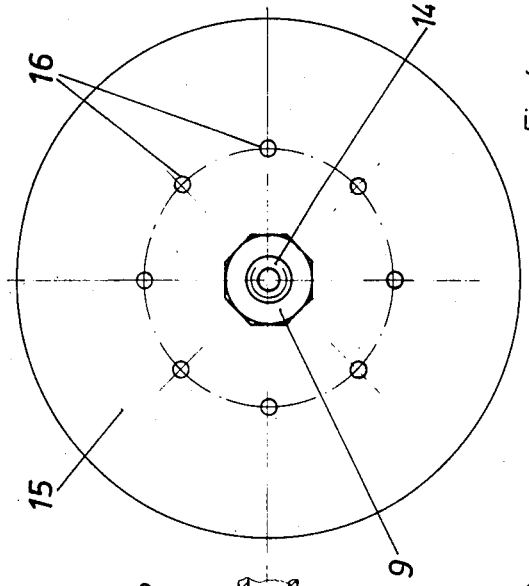
FIG. 4 shows the ventilator of FIG. 3 in a front view.
Figure 3:
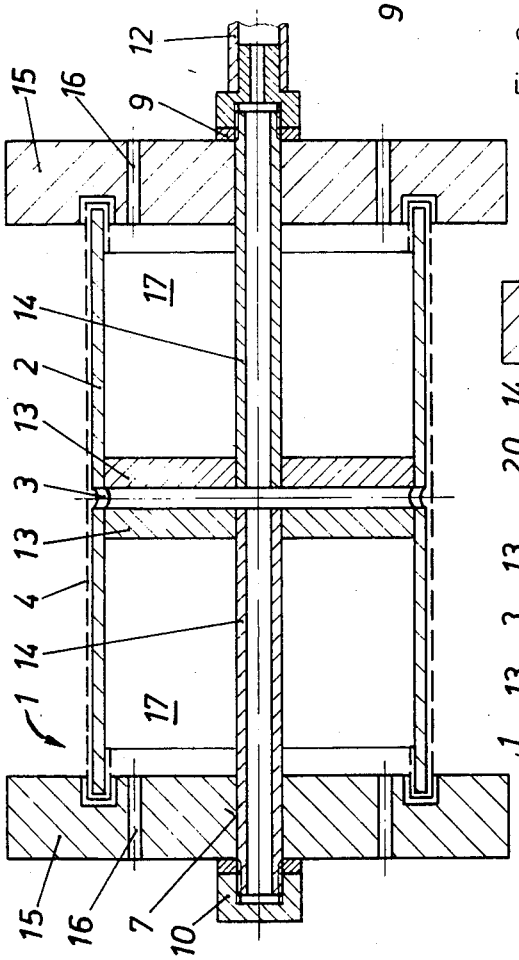
FIG. 3 is a not-to-scale representation, shows a second type of embodiment of a tubular ventilator according to the invention, in a sectional view.

FIGS. 3 and 4 show a second type of embodiment of a tubular ventilator 1 which is designed in accordance with the same principle but, by flooding the major part of the hollow space of the supporting tube 2, is capable of being lowered in a liquid or fluid. Relative thereto it is assumed that the material used for both the supporting tube and the covers is heavier than the liquid. Preferably, this material is PVC-hard which has the property of not reacting with water.

Compared to the embodiment described hereinbefore, this supporting tube 2, by the use of two spaced-apart partition walls 13, is subdivided into two halves. The ends of the tube are closed by disk-shaped covers 15, each likewise having a center bore 7. Through each of these there extends a pipe line 14 which, with its other end, passes through the respective partition wall 14 and is connected thereto in a pressure- and tension-resisting manner. The respective free end of the pipe lines 14 is provided with a thread. Nuts 9 serve to secure the pressure-resistant seating of the covers 15 and safeguard a proper sealing of the pipeline bushing. The projecting ends of the threads can be used, as already mentioned hereinbefore, either for connecting the pressure line 12 or for taking up an end cover or cap 10. Within the area of the supporting tube 2, the covers 15 are provided with a number of circularly arranged holes 16 as is well recognizable from FIG. 4. Through these holes 16 the chambers 17 as formed by the partition walls 13, are accessible from the outside. The radial bores 3 in the supporting tube 2 open out into the interspace between the two partition walls 13. The disk-shaped covers 15 each have a diameter amounting to a multiple of the supporting-tube diameter. The purpose of this is to prevent either the supporting tube 2 or the hose 4 through which the small gas bubbles escape, from coming in touch with the bottom whenever the ventilator 1 happens to run onto the floor (ground). When a ventilator 1 of the type described hereinbefore is introduced into a liquid or fluid, then the chambers 17 are flooded through the holes 16 and the ventilator 1 is gradually lowered onto the floor or ground. The pressurized gas as supplied through the line 12 is introduced via the pipe lines 14 into the space between the partition walls 13 from where it escapes outwardly through the radially bores 3 to the hose 4, and finally escapes through the pores thereof. Once in the lowered position, the ventilator 1 cannot be recovered with out further ado.

This, in fact, is made possible by employing the third type of embodiment which is shown in FIG. 5 of the drawings. As the basic construction thereof corresponds to that of FIGS. 3 and 4, FIG. 5 mainly only shows the right-hand half of the ventilator 1 in a sectional elevation, because the left-hand half is mirror-invertedly the same. Therefore, the following description applies analogously.

This embodiment differs from the aforementioned one in that the partition walls 13 are provided with boreholes 18 inside which adjustable outlet valves 19 are seated. Inside the chambers 17, opposite the inside wall of the supporting tube 2 and the pipelines 14, one plunger disk 20 each is disposed pressure-tightly and displaceable. A compression spring 21 is arranged between the respective cover 15 and the associated plunger disk 20. The force of this compression spring 21 has the tendency of urging the plunger disk 20 toward the partition wall 13. Without being opposed by any countereffect, the plunger disk 20 is displaced until it meets against the partition wall 13. Thus, after the ventilator 1 has been inserted or introduced into the liquid, the chambers 17 are flooded or filled, and the ventilator 1 sinks on to the ground.

The outlet valves 19 are so adjusted as not to open when subjected to a normal ventilating-gas pressure. In this way, it is made sure that the ventilator 1, during the ventilation or aeration process, is prevented from rising or floating up. However, upon increasing the gas pressure, the valves 19 are caused to open, and by the gas pressure the plunger disks 20 are displaced, in opposition to the force of the springs 21 and the pressure of the liquid, toward the cover 15. The liquid is now pressed-out through the holes 16 and the hollow space inside the chambers 17 increases continually until the buoyancy or uplift has become large enough to cause the ventilator 1 to rise or float up. Once it arrives at the surface, it can be easily cleaned or lifted out for repair purposes. For effecting a new sinking or lowering there is provided a not shown hand-operated valve by means of which the gas inside the chambers 17 can be let off.

FIGS. 6 and 7, in the form of a schematical, sectional representation and a diagram, refer to a fourth type of embodiment of a tubular ventilator 1 respectively. Here, too, and for the same reasons as already mentioned hereinbefore, only the right-hand half of the ventilator or aerator 1 is shown. This type of embodiment permits the ventilator 1 to be adjusted to a defined depth of water. Since in this case the ventilator does not come in contact with the ground, the disk-shaped covers 22 have a diameter which is not much larger than that of the supporting tube 2. Also, in this case, the cover has holes 16 for flooding the chambers 17. Moreover, each of the covers 22 comprises an integrated fine-pressure differential-pressure switch 23. Switches of this type are manufactured, for example, by the German firm of Herion-Werke KG, Fellbach/Wüttemberg. Via a pressure-measuring channel 25, the differential-pressure switch 23 is in connection with the liquid surrounding the ventilator 1. The switch 23 itself is controlled via a final positioning element 24 which is led to the outside. The plunger disks 20 each have two bores 27 inside which either a controlled inlet valve 28 or a controlled outlet valve 29 is disposed respectively. One flexible pressure hose 26 each is connected to the bore 27 of the inlet valve 28, with these hoses being led from the outside in a pressure-tight manner through the respective cover 22 into the chambers 17. Inside the flexible pressure hoses 26 the power supply and control leads extending to both the switches 23 and the valves 28 and 29 are installed in the manner (not shown in greater detail), but as known per se.

The differential-pressure switch 23 as adjusted to a defined or predetermined depth of water, in dependence upon the pressure of the liquid surrounding the ventilator 1 and in the form of a feedback control system of the type as shown in FIG. 7 by way of a diagram, performs its control function in such a way that the plunger disk 20 is brought exactly into the position in which the ventilator 1 floatingly remains at the precisely defined depth of water level, with the pressurized gas required for effecting any necessary readjustment being supplied from the outside through the hose 26.

FIG. 8, in a schematical representation, shows a tubular ventilator 1 comprising a deep-water aeration facility. By means of this it can be avoided that, for example, the entire liquid layers are mixed. As FIG. 8 permits to recognize, the tubular ventilator 1 is in a floating state at the $T_2$ depth-of-water level. To the outer surfaces of the covers 22 suspending or holding ropes 31 are mounted, and the other ends thereof are hooked into the outer edges of a tent-like catcher 30 which is impermeable to gas. The lower edge of the catcher 30 is shown to be positioned at the $T_1$ depth-of-water level. A controlled valve 32 is shown to be provided for at the roof-ridge of the catcher 30, to which a return line 33 is connected. Into the pressure line 12 serving the gas supply there is inserted a Y-shaped tube-connecting sleeve 34 of the type as shown in the drawing, to the free Y pipe of which the return line 33 is connected.

The gas as streaming out or escaping from the ventilator 1 in the finest distribution intersperses the liquid within the $T_2$–$T_1$ range of depth. Any gases not dissolved in the liquid are caught by the tent-shaped catcher 30 and reintroduced into the pressure line 12 via both the valve 32 and the line 33, from where they are fed in spite of the existing pressure difference between the two lines, to reuse in accordance with the communicating-tube principle as applied to streaming media. Relative thereto, the valve 32 is adjusted that, on the one hand, liquid is prevented from entering into the return line and, on the other hand, the rising gas is reliably prevented from reaching the surface of the liquid.

We claim:

1. A tubular ventilator for introducing gases into liquids, comprising a rigid supporting tube having two spaced ends and being provided with a plurality of radial bores; a hose provided with a plurality of fine pores and surrounding said supporting tube; two covers each tightly closing a respective one of said ends of said supporting tube; means for subdividing the interior of said supporting tube into two tube halves; means for supplying gas into each of said tube halves; at least one hole provided in each of said covers and communicating a respective one of said tube halves with outside; and two plungers each pressure-tightly displaceable in a respective one of said tube halves.

2. A tubular ventilator as defined in claim 1, wherein said supporting tube has a predetermined diameter, each of said covers having a diameter which is by a multiple larger than the diameter of said supporting tube.

3. A tubular ventilator as defined in claim 1, wherein said gas supplying means include two pipes each extending concentrically with said supporting tube and through a respective one of said covers and a respective one of said tube halves.

4. A tubular ventilator as defined in claim 3, wherein said gas supplying means include two lines each connected with a respective one of said pipes.

5. A tubular ventilator as defined in claim 4, and further comprising a tent-like gas impermeable catcher having a roof ridge; a return line connected with said roof ridge of said catcher; and a Y-shaped connecting sleeve which connects said return line with said gas line.

6. A tubular ventilator as defined in claim 5; and further comprising a differential pressure valve arranged at said roof ridge of said catcher for said return line.

7. A tubular ventilator as defined in claim 5; and further comprising means for fastening said catcher to said covers.

8. A tubular ventilator as defined in claim 7, wherein said connecting means is formed as means for suspending said catcher on said covers.

9. A tubular ventilator as defined in claim 7, wherein said connecting means is formed as holding ropes for fastening said catcher on said covers.

10. A tubular ventilator as defined in claim 1; and further comprising two pressure springs each arranged in a respective one of said tube halves between a respective one of said covers and a respective one of said plungers.

11. A tubular ventilator as defined in claim 10, wherein said subdividing means include two spaced apart partition walls located inside said supporting tube, said radial bores being provided between said partition walls; and further comprising two adjustable outlet valves each provided in a respective one of said partition walls.

12. A tubular ventilator as defined in claim 10, wherein each of said plungers has at least one controlled inlet valve and one controlled outlet valve; and further comprising two differential pressure switches each provided for controlling one of said inlet valves and one of said outlet valves and arranged in said supporting tube so as to be acted upon by external liquid pressure; and two flexible pressure hose members each connected with a respective one of said inlet valves and extending from outside through a respective one of said covers.

13. A tubular ventilator as defined in claim 12, wherein each of said differential pressure switches is arranged in a respective one of said covers.

14. A tubular ventilator as defined in claim 12; and further comprising power supply and control leads extending to said differential pressure switches and said valves and arranged in said flexible pressure hose members.

* * * * *